US008641184B2

(12) United States Patent
Nishiberi et al.

(10) Patent No.: US 8,641,184 B2
(45) Date of Patent: Feb. 4, 2014

(54) CONVEYING MECHANISM AND RECORDING APPARATUS INCLUDING THE SAME

(75) Inventors: Nozomu Nishiberi, Yokohama (JP); Yasufumi Tanaami, Tokyo (JP); Yasuyuki Hirai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 176 days.

(21) Appl. No.: 12/946,358

(22) Filed: Nov. 15, 2010

(65) Prior Publication Data

US 2011/0134201 A1 Jun. 9, 2011

(30) Foreign Application Priority Data

Dec. 8, 2009 (JP) ..... 2009-278390

(51) Int. Cl.
*B41J 2/01* (2006.01)
*B41J 11/00* (2006.01)

(52) U.S. Cl.
CPC ..... *B41J 11/007* (2013.01)
USPC ..... 347/104; 271/7

(58) Field of Classification Search
USPC ..... 347/104
See application file for complete search history.

(56) References Cited

U.S. PATENT DOCUMENTS

2002/0067401 A1* 6/2002 Yraceburu et al. ..... 347/102
2005/0105937 A1* 5/2005 Sakai ..... 399/301
2006/0209151 A1* 9/2006 Tamiya et al. ..... 347/103
2007/0246879 A1* 10/2007 Sagawa et al. ..... 271/12
2008/0239053 A1* 10/2008 Sakano ..... 347/104
2008/0253797 A1* 10/2008 Sakagami ..... 399/92
2010/0154949 A1* 6/2010 Nagai ..... 152/209.5

FOREIGN PATENT DOCUMENTS

JP 2005-305688 A 11/2005
JP 2007-175907 A 7/2007
JP 2007-210725 A 8/2007
JP 2008-200972 A 9/2008

* cited by examiner

*Primary Examiner* — Manish S Shah
*Assistant Examiner* — Jeffrey C Morgan
(74) *Attorney, Agent, or Firm* — Fitzpatrick, Cella, Harper & Scinto

(57) ABSTRACT

Provided is a recording medium conveying mechanism including an endless center conveying belt and endless side conveying belts, the endless center conveying belt and the endless side conveying belts being looped over a driving roller to be driven by a motor, a driven roller and a tension roller. The center conveying belt is positioned in a center in a width direction of a recording medium to be conveyed, and the side conveying belts are positioned on opposite sides in a width direction of the center conveying belt, respectively. The center conveying belt includes a material with a high elastic modulus while the side conveying belts include a material with a low elastic modulus, and a biasing member for providing a tension to the center conveying belt and the side conveying belts is provided on a shaft of the tension roller.

8 Claims, 5 Drawing Sheets

CONVEYING MECHANISM AND RECORDING APPARATUS INCLUDING THE SAME

BACKGROUND OF THE INVENTION

1. Field of the Invention

The present invention relates to a conveying mechanism that conveys a recording medium by means of conveying belts, and a recording apparatus including the same.

2. Description of the Related Art

An inkjet recording apparatus is an apparatus that discharges minute ink droplets from a plurality of nozzles provided in a recording head, forming an image on a recording medium. Examples of the recording head include a recording head mounted on a carriage that is movable in the width direction of the recording medium, the recording head performing recording on the entire range in the width direction of the recording medium while moving in the width direction of the recording medium, and a plurality of recording heads arranged in a line covering the entire range in the width direction of the recording medium to perform recording.

Examples of a method for conveying a recording medium in an inkjet recording apparatus include looping an endless belt (hereinafter referred to as "conveying belt") over a plurality of rollers including a driving roller to convey a recording medium, which is brought into contact with a front surface of the conveying belt. One of the methods for enhancing the recording medium's contact with the conveying belt is an electrostatic attraction method in which charge is applied to the front surface of the conveying belt to attract a recording medium to the belt by means of an electrostatic force.

For a method for controlling a conveying belt used in a conveying belt-used conveying mechanism, controlling a conveying belt by directly detecting movements of the conveying belt itself has been proposed in, for example, Japanese Patent Application Laid-Open No. 2007-210725. In this method, a scale pattern is formed integrally with a portion of a conveying belt, or a scale member is stuck on a front or back surface of a conveying belt, and the scale pattern or member is read by means of an encoder. In such conveying mechanism, the recording medium electrostatically attracted to the conveying belt can be considered as moving together with the conveying belt. In other words, reading movements of the conveying belt can be considered as being equivalent to directly reading movements of the recording medium, enabling provision of high-precision conveyance.

For performing what is called "borderless recording", which causes no margins in the edge portions of a recording medium, in a recording apparatus employing such conveying belt-used electrostatic attraction conveyance method, a plurality of conveying belts is arranged in the width direction of a recording medium to be conveyed (see, for example, Japanese Patent Application Laid-Open No. 2005-305688). When borderless recording is performed, ink is discharged outside a recording medium, and thus, the conveying belts are arranged so that clearances are formed around the opposite edges in the width direction of the recording medium, enabling prevention of the conveying belts from being contaminated by ink. In this method, in order to conform to various recording medium sizes, a plurality of conveying belts is arranged so as to form clearances around the opposite edges in the width direction of a recording medium of a respective size (see FIG. 4 in Japanese Patent Application Laid-Open No. 2005-305688). Consequently, the ink discharged outside the recording medium arrives at these clearances, preventing the conveying belts from being contaminated.

In conveyance of a recording medium using a plurality of conveying belts, the speeds of movement of the conveying belts may differ depending on, e.g., the differences in material among the respective conveying belts, and/or the differences in circumferential length and/or thickness among the respective conveying belts, resulting in the amounts of conveyance of the recording medium differing depending on each conveying belt. Consequently, a problem arises in that the recording medium cannot be conveyed straight. In order to solve this problem, increasing the conveyance force of a particular conveying belt from among a plurality of conveying belts to be higher than those of the other conveying belts has been proposed (see, for example, Japanese Patent Application Laid-Open No. 2007-175907). In this method, the conveying belts other than the particular conveying belt, which have a smaller conveyance force, cause slippage between the respective conveying belts and a recording medium, and the particular conveying belt having a large conveyance force conveys the recording medium, reducing the differences in the conveyance amount of the recording medium among the conveying belts. Furthermore, in order to eliminate the differences in recording medium conveyance speed among the respective conveying belts, detecting movements of the respective conveying belts and driving the conveying belts individually has been proposed (see, for example, Japanese Patent Application Laid-Open No. 2008-200972).

In order to eliminate the differences in recording medium conveyance speed among a plurality of conveying belts in the aforementioned method disclosed in Japanese Patent Application Laid-Open No. 2007-175907, it is necessary to provide a driving mechanism, a conveying belt movement detecting mechanism and a conveying belt movement adjusting mechanism for each conveying belt to adjust the driving force and movement of the conveying belt, resulting in an increase in cost and recording apparatus size. Furthermore, where none of a driving mechanism, a movement detecting mechanism and a movement adjusting mechanism is provided for each conveying belt, in order to eliminate the differences in conveyance speed among the respective conveying belts, it is necessary to provide a tension to the respective conveying belts to eliminate looseness of the conveying belts. Actual conveying belts may have an error in circumferential length depending on their materials and manufacturing methods. Accordingly, where the respective conveying belts include a material with a high elastic modulus, if all the conveying belts are looped over a same tension roller, it is difficult to provide a tension to all the conveying belts because the respective conveying belts extend/contract only to a small degree. More specifically, it is difficult to provide a tension to the conveying belt with the largest circumferential length. Therefore, a tension roller is provided for each conveying belt in addition to a plurality of rollers included in the conveying mechanism. Consequently, a tension can be provided to all the conveying belts, which, however, results in an increase in cost and apparatus size.

Where conveying belts include a material with a low elastic modulus, which can extend/contract, a tension can be provided to all the conveying belts by means of one roller. However, if conveying belts include a material with a low elastic modulus, it is difficult to directly detect the movement amounts of conveying belts to enhance the recording medium conveyance precision by means of the aforementioned method disclosed in Japanese Patent Application Laid-Open No. 2007-210725. More specifically, because the conveying belts extend/contract to a large degree, it is difficult to precisely detect the movement amounts of the conveying belts, resulting in deterioration in recording medium conveyance precision.

SUMMARY OF THE INVENTION

Therefore, the present invention provides a conveying mechanism including a plurality of conveying belts, which solves the aforementioned problems, i.e., enables high-precision recording medium conveyance without an increase in cost and apparatus size, and a recording apparatus including the conveying mechanism.

A conveying mechanism for a recording medium according to the present invention includes: an endless center conveying belt and endless side conveying belts, the endless center conveying belt and the endless side conveying belts being looped over a driving roller to be driven by a motor, a driven roller and a tension roller. The center conveying belt is positioned in a center in a width direction of the recording medium to be conveyed, and the side conveying belts are positioned on opposite sides in a width direction of the center conveying belt, respectively. The center conveying belt includes a material with a high elastic modulus while the side conveying belts include a material with a low elastic modulus, and a biasing member for providing a tension to the center conveying belt and the side conveying belts is provided on a shaft of the tension roller.

The present invention enables provision of a tension to all the conveying belts by means of one tension roller, and direct and precise detection of the movement amounts of the conveying belts, providing high-precision recording medium conveyance while suppressing an increase in cost and apparatus size.

Further features of the present invention will become apparent from the following description of exemplary embodiments with reference to the attached drawings.

DESCRIPTION OF THE EMBODIMENTS

Figure 1:
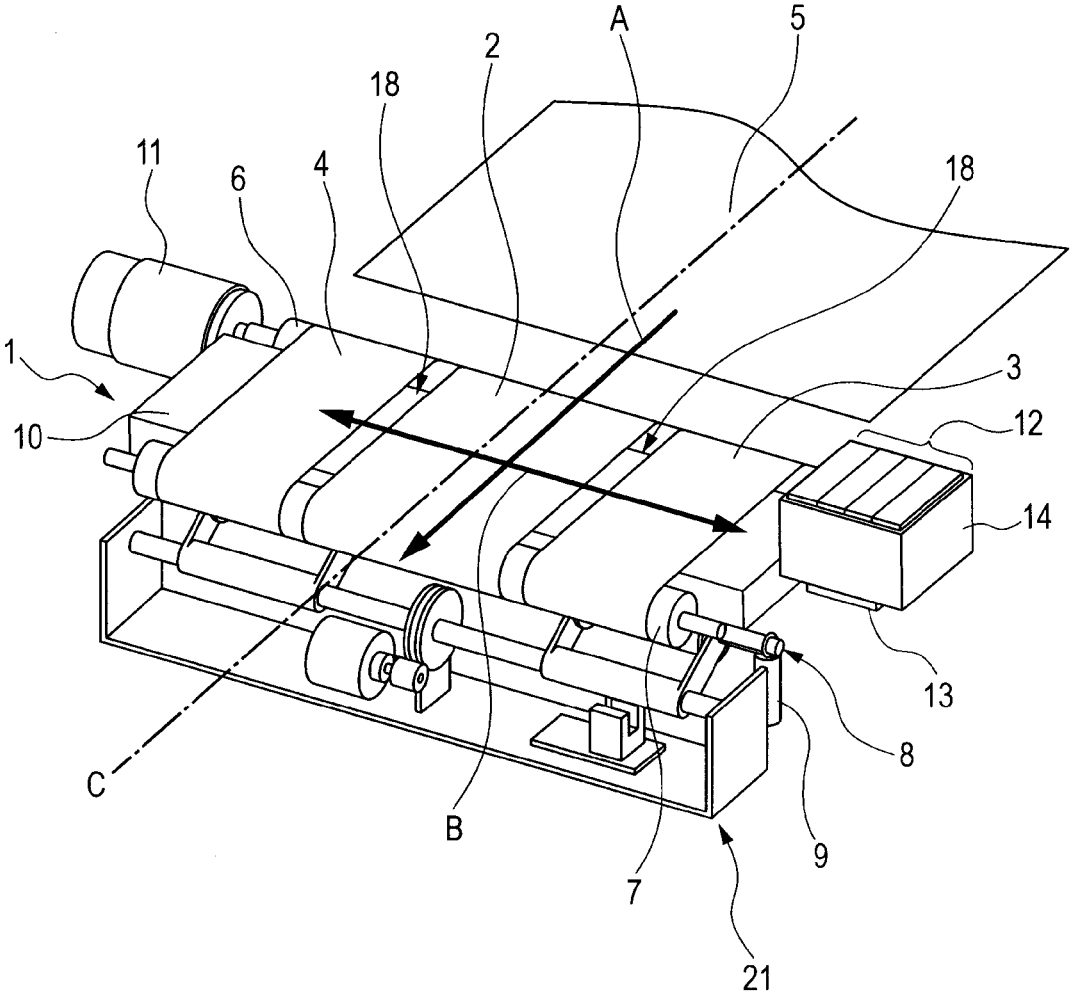
FIG. 1 is a schematic perspective view of a recording medium conveying mechanism in an inkjet recording apparatus according to the present invention.

Hereinafter, embodiments of the present invention will be described in detail below with reference to the attached drawings. Components having a same function will be provided with a same reference numeral in the attached drawings, and a description thereof may be omitted.

FIG. 1 is a schematic perspective view of a recording medium conveying mechanism 1 in an inkjet recording apparatus according to the present invention.

In order to convey a sheet-like recording medium 5, the recording medium conveying mechanism 1 includes a center conveying belt 2, side conveying belts 3 and 4 positioned on opposite sides in the width direction of the center conveying belt 2. Front surfaces of the conveying belts 2 to 4 on a conveying path of the recording medium 5 are conveying surfaces for conveying the recording medium 5. A clearance 18 is provided between the center conveying belt 2 and each of the side conveying belts 3 and 4. Each of the conveying belts 2 to 4 is an endless belt and includes an insulating layer on the front surface thereof. The side conveying belts 3 and 4 are symmetrically arranged with reference to a center line C of the center conveying belt 2. The center line C corresponds to a center line in the width direction of the recording medium 5 to be conveyed. The conveying belts 2 to 4 are looped over a driving roller 6, a driven roller 7, and a tension roller 8, which is included in a part of a later-described side conveying belt moving mechanism 21 and provided with a tension by a spring 9, which is an example of a biasing member. A platen 10 is arranged between the driving roller and the driven roller 7 in an inner circumferential portion of the conveying belts 2 to 4. The driving roller 6 is connected to a conveying motor 11, and the conveying belts 2 to 4 are driven in a state in which the driving roller 6 is driven by the conveying motor 11 and a tension is provided to the conveying belts 2 to 4 by the tension roller 8. The biasing member is not limited to the spring 9, and any mechanism for biasing the tension roller 8 in a particular direction can be employed.

The recording medium conveying mechanism 1 also includes a carriage 14 including ink tanks 12 and a recording head 13, which moves in the width direction (arrow B in FIG. 1) of the recording medium 5 and performs recording.

The recording medium 5 is conveyed one by one from a sheet feeding mechanism (not illustrated) in the direction of arrow A to the recording medium conveying mechanism 1, and the carriage 14 performs a reciprocating operation in the width direction of the recording medium 5 to perform recording. Along with the reciprocating operation of the carriage 14, the recording medium 5 is gradually conveyed in the direction of arrow A, and the recording medium 5 subsequent to recording is output to the downstream side in the conveying direction.

Figure 2A:
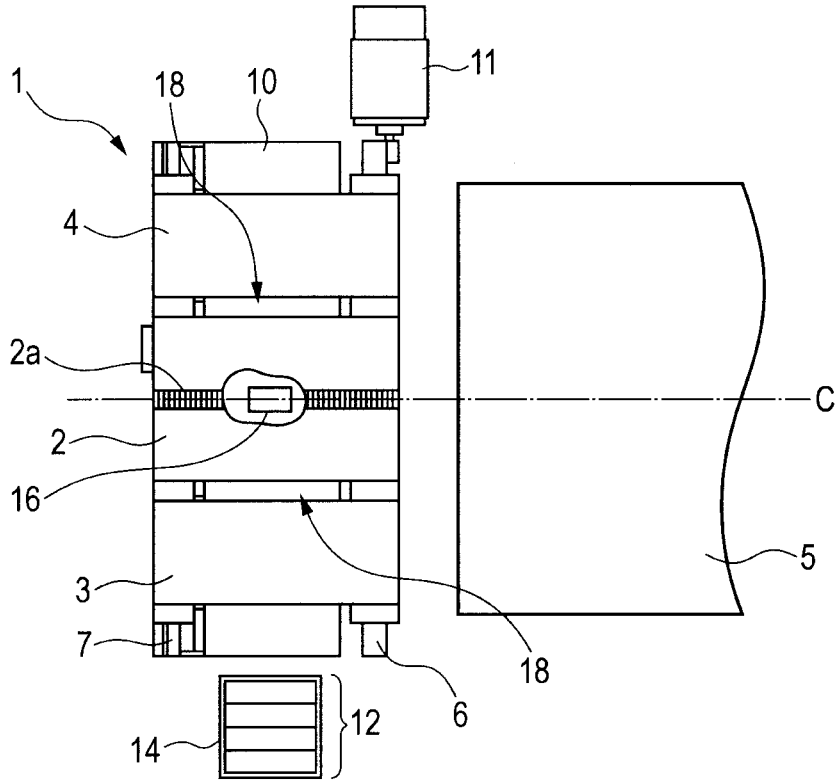
FIG. 2A is a schematic top view providing a detailed illustration of the recording medium conveying mechanism in FIG. 1.
Figure 2B:
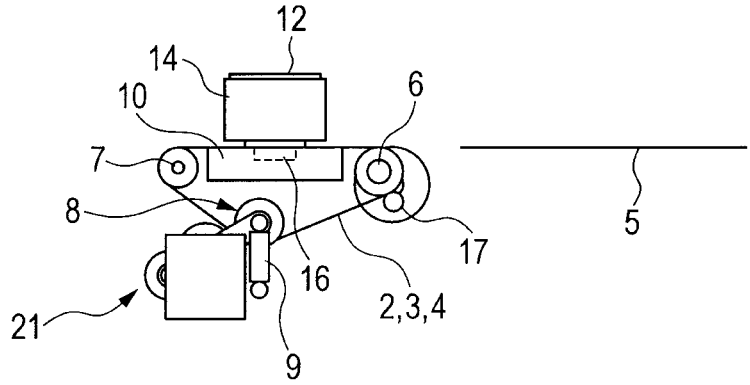
FIG. 2B is a schematic side view providing a detailed illustration of the recording medium conveying mechanism in FIG. 1.

FIGS. 2A and 2B are schematic diagrams illustrating details of the recording medium conveying mechanism 1 in FIG. 1; FIG. 2A is a partially-perspective top view of the recording medium conveying mechanism 1; and FIG. 2B is a side view of the recording medium conveying mechanism 1.

Slit-like marks 2*a* are provided at equal spaces over the entire circumference along the center line C on a back surface of the center conveying belt 2. An encoder sensor 16 is provided at a position on a front surface of the platen 10, facing the slits 2*a* provided on the back surface of the center conveying belt 2. The encoder sensor 16 detects the slits 2*a* to measure a movement amount of the center conveying belt 2. The conveying motor 11 is controlled by a control unit that controls operation of the conveying motor 11. In response to an instruction of the control unit, the conveying motor 11 is driven/halted according to the movement amount of the center conveying belt 2 detected by the encoder sensor 16. The marks 2*a* may be formed by printing, or may also be formed by slits, or projections or recesses.

Figure 6:
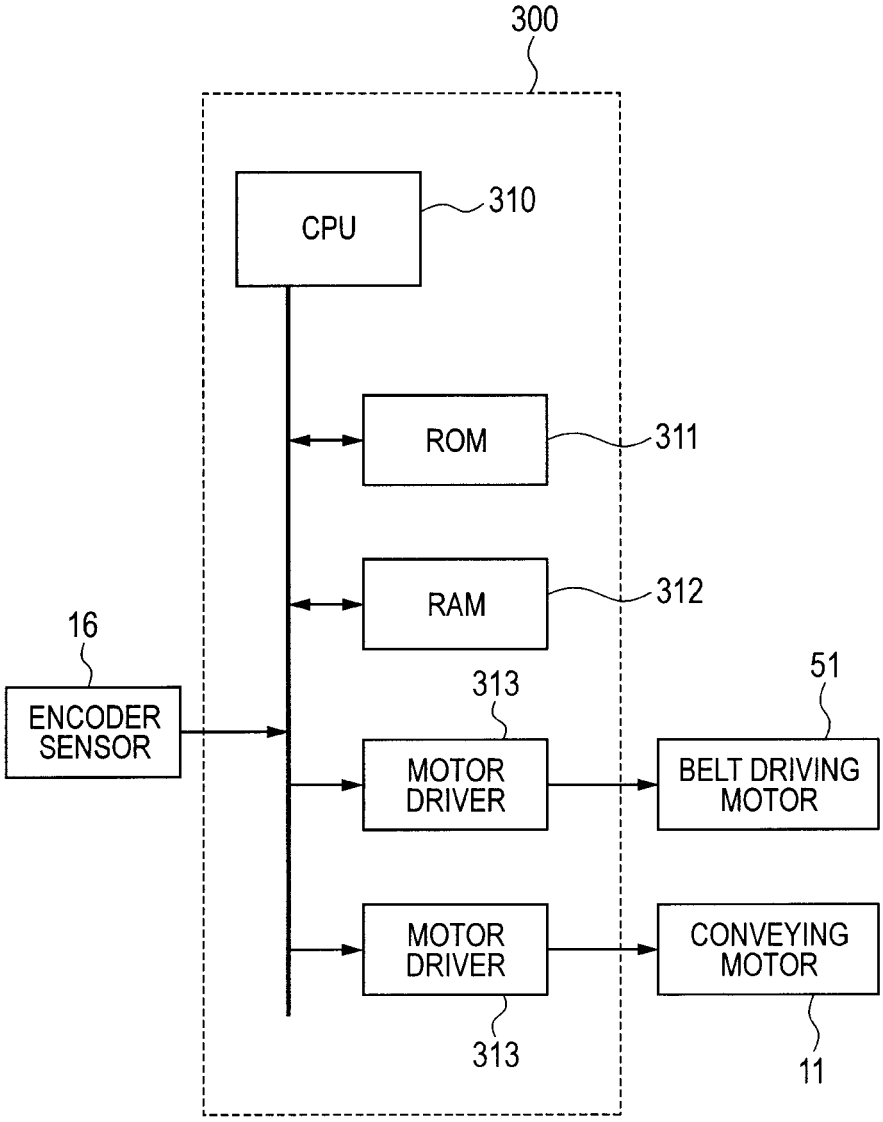
FIG. 6 is a control block diagram.

FIG. 6 is a control block diagram.

A control board 300, which is the control unit, includes, e.g., a CPU 310 that performs control of the double-side recording apparatus and provides various control instructions, a ROM 311 with, e.g., control data written therein, a RAM 312, which is an area for developing, e.g., recording data. A belt driving motor 51 will be described later. Motor drivers 313 are provided for the respective motors.

The conveying belts 2 to 4 are sandwiched between the driving roller 6 and a power feed roller 17 at a position that is not on the conveying route of the recording medium 5. Although in the present embodiment, the conveying belts 2 to 4 are sandwiched between the driving roller 6 and the power feed roller 17, an arrangement may be made so that the conveying belts 2 to 4 are sandwiched between the power feed roller 17 and the driven roller 7 or the tension roller 8. Furthermore, when the recording medium 5 is conveyed, a voltage is applied to the power feed roller 17, and the power feed roller 17 provides charge to the front surfaces of the conveying belts 2 to 4. As described above, the respective front surfaces of the conveying belt 2 to 4 include an insulating layer, providing a mechanism in which the charge remains on the front surfaces of the conveying belts 2 to 4, causing an electrostatic force between the conveyed recording medium 5 and the front surfaces of the conveying belt 2 to 4, that is, the surfaces for conveying the recording medium 5, resulting in the conveyed recording medium 5 and the conveying belt 2 to 4 being attracted to each other.

Here, the center conveying belt 2 includes a material having a high elastic modulus, for example, polyimide or an ethylene-tetrafluoroethylene (ETFE) copolymer, while the side conveying belts 3 and 4 include, for example, a material having a low elastic modulus, for example, an ethylene-propylene-diene monomer (EPDM) rubber. Also, in a state in which no tension has been provided, the circumferential length of the center conveying belt 2 is set to be somewhat longer than the circumferential lengths of the side conveying belts 3 and 4. Since the center conveying belt 2 has a high elastic modulus and thus, extends/contracts only to a small degree, the distances between the shafts of the respective rollers 6 to 8 are adjusted so as to conform to the center conveying belt 2. Meanwhile, the side conveying belts 3 and 4 have a low elastic modulus, and thus, extend/contract so as to conform to the distances between the shafts, which are determined depending on the center conveying belt 2.

As described above, as a result of including an material having a high elastic modulus, the center conveying belt 2 extends/contracts only to a small degree, enabling the movement amount of the center conveying belt 2 to be directly detected by the encoder sensor 16 with high precision. Also, the side conveying belts 3 and 4 are made to include a material with a low elastic modulus, and the circumferential lengths of the side conveying belts 3 and 4 are made to be shorter than the circumferential length of the center conveying belt 2. Then, the distances between the shafts of the respective rollers 6 to 8 are adjusted so as to conform to the length of the center conveying belt 2, resulting in a tension being provided to the side conveying belts 3 and 4 when the conveying belts 2 to 4 are looped over the rollers 6 to 8. An additional tension can be provided to the conveying belt 2 to 4 by the tension roller 8, which will be described later. Accordingly, as opposed to the conventional techniques, there is neither difficulty in directly detecting conveying belt movement to convey the recording medium 5 with high precision, nor need to provide a mechanism to provide different tensions to the conveying belts 2 to 4.

Figure 3:
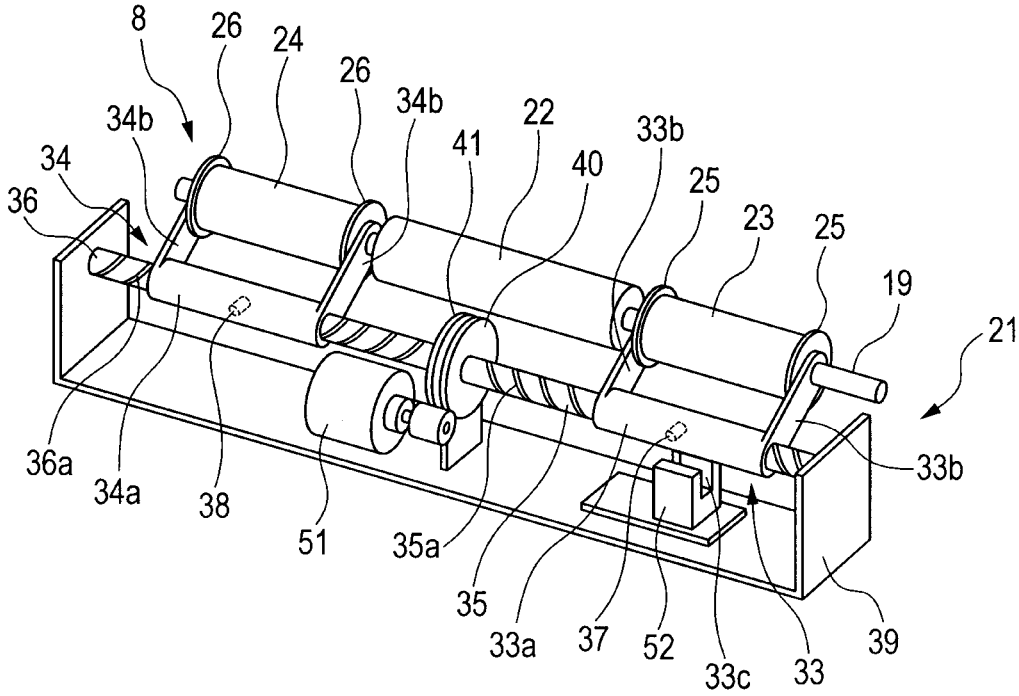
FIG. 3 is a schematic perspective view of a side conveying belt moving mechanism in the recording medium conveying mechanism in FIG. 1.

FIG. 3 is a schematic perspective view of the side conveying belt moving mechanism 21. The tension roller 8 includes a tension shaft 19, a center collar 22, which is a roller provided on the same axis as that of the tension shaft 19 and capable of idly rotating with reference to the tension shaft 19, and side collars 23 and 24 positioned on opposite sides of the center collar 22. The center conveying belt 2 (see FIG. 1) is looped over the center collar 22, and the side conveying belts 3 and 4 (see FIG. 1) are looped over the side collars 23 and 24, respectively. Flanges 25 and 26 are provided at respective opposite ends of the side collars 23 and 24. The flanges 25 and 26 restrict movement in the width direction of the side conveying belts 3 and 4. As described above, the spring 9 (see FIG. 1) is connected to the tension shaft 19, enabling the tension roller 8 to provide a tension to the conveying belts 2 to 4.

Also, a moving lever 33 including a cylindrical portion 33*a*, and end plates 33*b* extending from opposite ends of the cylindrical portion 33*a* so as to sandwich the flanges 25 is provided. Similarly, a moving lever 34 including a cylindrical portion 34*a* and end plates 34*b* extending from opposite ends of the cylindrical portion 34*a* so as to sandwich the flanges 26 is provided.

Rod-like lead screws 35 and 36, which have a round cross section, are provided so as to penetrate the cylindrical portions 33*a* and 34*a*, respectively, and shafts 37 and 38 are provided inside the cylindrical portions 33*a* and 34*a*, respectively, so as to extend inward. On the surfaces of the lead screws 35 and 36, grooves 35*a* and 36*a* are provided in mutually opposite directions, and the shafts 37 and 38 fit in the grooves 35*a* and 36*a* inside the cylindrical portions 33*a* and 34*a*, respectively. Ends on the respective outer sides in the width direction of the lead screws 35 and 36 are pivotally supported by a chassis 39, while ends in the center potion in the width direction of the lead screws 35 and 36 are coupled to gears 40 and 41. A conveying belt moving motor 51 is connected to the gears 40 and 41. Furthermore, a part of the moving lever 33 is provided with a shield plate 33*c*, and the position of the shield plate 33*c* is detected by a photosensor 52 fixed to the chassis 39. As described above, the grooves 35*a* and 36*a* provided in the lead screws 35 and 36 extend in mutually opposite directions, and thus, the moving levers 33 and 34 can simultaneously be moved toward the center portion in the width direction or toward the outsides in the width direction, according to driving of the conveying belt moving motor 51. As a result of the movement of the moving levers 33 and 34, the side collars 23 and 24 sandwiched by the respective opposite ends of the moving levers 33 and 34 are brought close to or away from center collar 22 along the shaft 19.

Moving the side collars 23 and 24 by driving the conveying belt moving motor 51 while rotating the conveying belts 2 to 4 by driving the conveying motor 11 by means of the above-mentioned mechanism enables the positions in the width direction of the side conveying belts 3 and 4 to be moved following the side collars 23 and 24. In other words, the side conveying belts 3 and 4 can be brought close to or away from the center conveying belt 2. The position of the side collar 23 is detected by the photosensor 52, and when it has been detected that the side collar 23 has reached a designated position, the movement of the side collars 23 and 24 is halted by halting the conveying belt moving motor 51.

Although any of various sizes of recording mediums can be used as the recording medium 5, here, a description will be given in terms of the case where recording is performed on an L-size recording medium 5*a* as an example of a small-size recording medium, and the case where recording is performed on an A4-size recording medium 5*b* as an example of a large-size recording medium.

Figure 4:
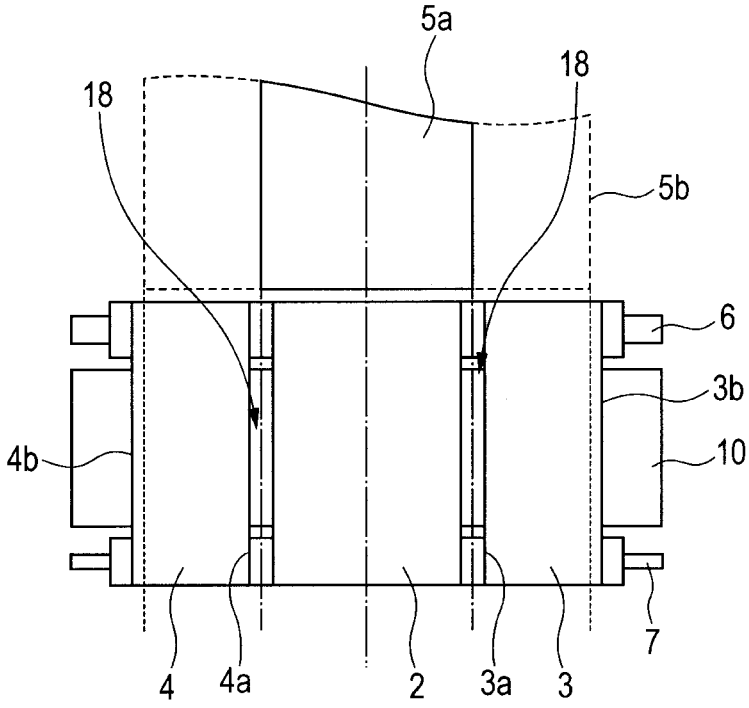
FIG. 4 is a top view of a recording medium conveying mechanism, which illustrates positions of conveying belts when borderless recording is performed on an L-size recording medium.

FIG. 4 is a top view of the recording medium conveying mechanism 1, which indicates the positions of the conveying belt 2 to 4 where borderless recording is performed on an L-size recording medium 5*a*. An L-size recording medium 5*a* is indicated by solid lines while an A4-size recording medium 5*b* is indicated by dashed lines.

The width of the center conveying belt 2 is made to be somewhat smaller than the width of the recording medium 5*a*. Center-side edges 3*a* and 4*a* of the side conveying belts 3 and 4 are arranged at positions spaced from the edges in the width direction of the center conveying belt 2, and the edges in the width direction of the recording medium 5*a* are brought onto the clearances 18 between the center conveying belt 2 and the side conveying belts 3 and 4. In this state, the outer-side edges 3*b* and 4*b* of the conveying belt 3 and 4 are set to be outside the edges in the width direction of the A4-size recording medium 5*b*.

Discharged ink droplets running off from the edges in the width direction of the recording medium 5*a* land within the clearances 18. Accordingly, the movement mechanism according to the present invention enables borderless recording on the recording medium 5*a*, which provides no margins to the edges of the recording medium 5*a*, without contaminating the conveying belts 2 to 4. Also, a tension is provided to the conveying belts 2 to 4 by means of the tension roller 8, and thus, the movement amount of the center conveying belt 2 can be detected with precision, enabling more precise conveyance of the recording medium 5*a*.

Figure 5:
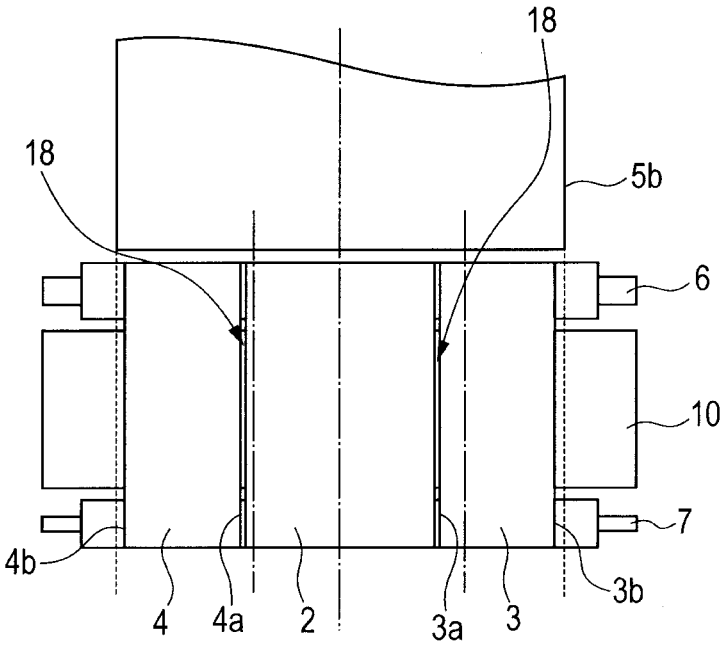
FIG. 5 is a top view of a recording medium conveying mechanism, which illustrates positions of conveying belts when borderless recording is performed on an A4-size recording medium.

FIG. 5 is a top view of the recording medium conveying mechanism 1, which indicates the positions of the conveying belts 2 to 4 when borderless recording is performed on an A4-size recording medium 5*b*. The side conveying belts 3 are 4 are moved toward the center side in the width direction by means of the above-described side conveying belt moving mechanism 21, and the clearances 18 between the center conveying belt 2 and the side conveying belts 3 and 4 are narrowed. Here, the outer-side edges 3*b* and 4*b* of the side conveying belts 3 and 4 are moved toward the center portion in the width direction, and thus, are positioned at positions inside the opposite edges in the width direction of the recording medium 5*b*. Consequently, as in the case of the L-size recording medium 5*a* described above, discharged ink droplets running off from the opposite edges in the width direction of the A4-size recording medium 5*b* land outside the side conveying belts 3 and 4. Accordingly, borderless recording can be performed also on the recording medium 5*b*, which provides no margins to the edges of the recording medium 5, without contaminating the side conveying belts 3 and 4. Also, as in the case of the L-size recording medium 5*a* described above, a tension is provided to the conveying belts 2 to 4 by means of the tension roller 8, and thus, the movement amount of the center conveying belt 2 can be detected with precision, enabling more precise conveyance of the recording medium 5*b*.

Preferably, ink absorbers are provided in positions on the platen 10 corresponding to the clearances between the center conveying belt 2 and the side conveying belts 3 and 4 as well as positions on the platen outside the side conveying belts 3 and 4 where ink droplets land, to hold the ink droplets.

As described above, in the present invention, as a result of the center conveying belt 2 including a material with a high elastic modulus, the center conveying belt 2 less likely to extend/contract, enabling the movement amount of the center conveying belt 2 to be directly detected with higher precision, and thus, a recording medium can be conveyed with high precision. Also, there is no need to provide additional devices for detecting the movement amounts of the center conveying belt and a recording medium, enabling suppression of an increase in cost and apparatus size.

In the present invention, the side conveying belts 3 and 4 include a material with a low elastic modulus, and the circumferential lengths of the side conveying belts 3 and 4 are made to be shorter than that of the center conveying belt 2. Consequently, when the distances between the shafts of the respective rollers 6 to 8 are adjusted so as to conform to the center conveying belt 2, the side conveying belts 3 and 4 extend, entering a state in which tension is provided to thereto because the circumferential lengths of the side conveying belts 3 and 4 are made to be shorter than that of the center conveying belt 2. Furthermore, all the conveying belts 2 to 4 are looped over one tension roller 8, enabling the tension roller 8 to provide a tension to all the conveying belts 2 to 4. Thus, there is no need to provide separate tension rollers 8 for the respective conveying belts 2 to 4, enabling suppression of an increase in cost and apparatus size.

The present embodiment has been described in terms of recording mediums 5*a* and 5*b* of two size types: L-size and A4 size, supposing that three conveying belts 2 to 4 are provided. Furthermore, a plurality of side conveying belts 3 and a plurality of side conveying belts 4, rather than one side conveying belt 3 and one side conveying belt 4, may be provided on opposite sides of a center conveying belt 2, and clearances 18 between the respective belts are set so as to conform to the opposite edges in the width direction of each recording medium 5, and these clearances are made so as to be movable. Consequently, the apparatus according to the present invention can handle any of various sizes of recording mediums 5 as well.

Although in the above description, the moving levers 33 and 34 are moved by one side conveying belt moving motor 51, two side conveying belt moving motors may be provided to individually move the moving levers 33 and 34. Furthermore, although the tension roller 8 provides a tension to the conveying belt 2 to 4 using the spring 9, a method for providing a tension to the conveying belts 2 to is not limited to the above method depending on the tension roller 8.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-278390, filed Dec. 8, 2009, which is hereby incorporated by reference herein in its entirety.

What is claimed is:

1. A conveying mechanism for a recording medium, the conveying mechanism comprising:

a first conveying belt configured to convey the recording medium in a conveying direction; and second and third conveying belts configured to convey the recording medium in the conveying direction, wherein the first, the second and the third conveying belts are arranged in a direction crossing the conveying direction and the first conveying belt is positioned between the second and third conveying belts, wherein an elastic modulus of a material included in the first conveying belt is higher than an elastic modulus of a material included in the second and the third conveying belts, and wherein circumferential lengths of the second and the third conveying belts are shorter than a circumferential length of the first conveying belt in a state in which no tension is provided to the first, second and third conveying belts.

2. The conveying mechanism according to claim 1, wherein the first conveying belt includes polyimide or an ethylene-tetrafluoroethylene copolymer, and each of the second and third conveying belts includes an ethylene-propylene-diene monomer rubber.

3. The conveying mechanism according to claim 1, wherein marks are provided on a back surface of the first conveying belt, and an encoder sensor is provided at a position facing the marks.

4. The conveying mechanism according to claim 1, wherein the second and third conveying belts are provided on opposite sides in a width direction of the first conveying belt.

5. A recording apparatus comprising the conveying mechanism according to claim 1 and a recording unit configured to record on the recording medium conveyed by the conveying mechanism.

6. The conveying mechanism according to claim 1, further comprising a tension roller configured to provide tension to the first, second and third conveying belts concurrently.

7. A method for conveying a recording medium in a recording medium conveying mechanism including a first conveying belt and second and third conveying belts, the method comprising:

forming a surface for conveying the recording medium using the first, second and third conveying belts;

providing the first conveying belt with a material having an elastic modulus that is higher than an elastic modulus of a provided material in the second and the third conveying belts;

providing the second and the third conveying belts with circumferential lengths that are shorter than a circumferential length of the first conveying belt in a state in which no tension is provided to the first, second and third conveying belts; and conveying the recording medium by the surface formed by the first, second and third conveying belts.

8. The method for conveying a recording medium according to claim 7, further comprising providing marks on a surface of the first conveying belt, and detecting the marks.

* * * * *